US005525122A

United States Patent [19]

Liebergott et al.

[11] Patent Number: 5,525,122

[45] Date of Patent: Jun. 11, 1996

[54] PROCESS AND APPARATUS FOR SHRINKING PREPARED BONDED FIBER COLOR PRINTED CELLULOSIC TYPE CURRENCY WITH ANHYDROUS AMMONIA

[76] Inventors: Norman Liebergott, 4298 9th Street, Chomedy, Quebec, Canada, H7W 1YL; Ira Brown, 6748 Hillpark Dr. #406, Los Angeles, Calif. 90068

[21] Appl. No.: 331,181

[22] Filed: Oct. 28, 1994

[51] Int. Cl.[6] ..... D06M 11/00; D21H 25/00

[52] U.S. Cl. ..... 8/116.1; 8/115.51; 8/147; 162/70

[58] Field of Search ..... 8/115.51, 116.1, 8/196, 147, 158; 162/9, 17, 19, 60, 70, 100

[56] References Cited

U.S. PATENT DOCUMENTS 4,869,782 9/1989 Nelson et al. ..... 162/9

OTHER PUBLICATIONS

Coles & Walker, Induced Shrinkage and Structural Reorganization in Ammonia—Treated Wood, 1978, Paperchem No. 50–03407.

Heap, S. A., Liquid Ammonia Treatment of Cotton Fabrics, Apr. 1976, Paperchem No. 48–03351.

CA 76(18):100991m, 1971.

*Primary Examiner*—Prince Willis, Jr.
*Assistant Examiner*—Alan D. Diamond

[57] ABSTRACT

A process and apparatus for the shrinkage of prepared bonded fiber color printed cellulosic type currency where in the process the prepared bonded fiber color printed cellulosic type currency is substantially free (known as oven dry and/or bone dry) before starting the procedure, then is immersed in anhydrous ammonia solution at low temperature, withdrawn and dried by different techniques. The process of immersing and drying is repeated 1 to 8 times. The apparatus to accomplish this provides for a closed loop and/or stainless steel rack and/or stainless steel tong with a thermally controlled vessel. All apparatus to be immersed and all apparatus to be used to contain the anhydrous ammonia solution should be made from a non-corrosive material (i.e. stainless steel and/or glass) to anhydrous ammonia. The color printing to the shrunken prepared bonded fiber color printed cellulosic type currency is not removed.

6 Claims, 3 Drawing Sheets

PROCESS AND APPARATUS FOR SHRINKING PREPARED BONDED FIBER COLOR PRINTED CELLULOSIC TYPE CURRENCY WITH ANHYDROUS AMMONIA

FIELD OF THE INVENTION

The present invention relates to the improvement in the shrinking methods for prepared bonded fiber color printed cellulosic type currency which does not remove the printed ink or colors of said material, but provides for a continuous and efficient manner to produce the product.

BACKGROUND ART

Ammonia-induced shrinkage of wood and the deformability of Anhydrous Ammonia treatment on textile fabric is known. Coles and Walker, induced shrinkage and structured reorganization in Ammonia treated wood or Corsican Pine, Wood Fiber 10, No. 1:39–57 (1978) measured the swelling of the wood along with the shrinkage over a wide range of temperature (–78° C. to 132° C.). Their main interest however was the plactization of the wood. Heap, S. A. ACS Symp. No. 49:63–72 (April 1976, published 1977) reported on the finishing treatment for Ammonia pretreated samples to produce a low add cross linking technique to improve crease recovery, tensile and tear strength of fabric. Lewin, m., and Roldan, L. G., J. Polym. SCI 36C: 213–229 looked at the effect of liquid Anhydrous Ammonia on the structure and morphology of cotton cellulose. Their main interest was to clarify the relationship of Cellulose I to Cellulose II and to obtain samples of Cellulose III. Notwithstanding the recognition of Anhydrous Ammonia as a swelling and shrinking agent the commercial use of this chemical has been limited because of its inherent properties and difficulty to use because of no commercial equipment to rapidly carry out the treatments.

SUMMARY OF INVENTION

The present invention overcomes the aforementioned problem associated with the prior process of treating cellulosic prepared bonded fiber with liquid Anhydrous Ammonia and rapid drying of said material. More particularly it provides for different apparatus to continuously immerse, remove and dry prepared bonded fiber color printed cellulosic type currency of any denomination and from any country without removing the color and printing of said prepared bonded fiber color printed cellulosic type currency.

DIFFERENT APPARATUS TO SHRINK PREPARED BONDED FIBER COLOR PRINTED CELLULOSIC TYPE CURRENCY

Figure 3:
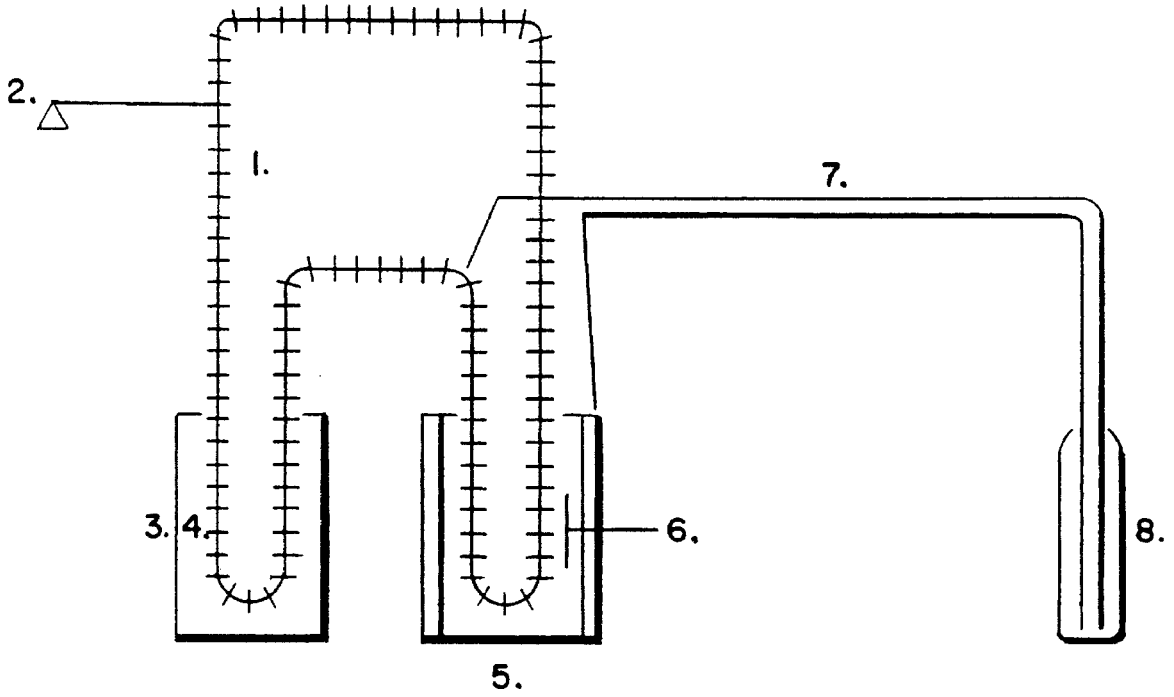
FIG. 3 shows the vertical cross section of an apparatus for continuous shrinking and drying of prepared bonded fiber color printed cellulosic type currency.

In the accompanying drawings, FIG. 3 is a diagrammatic vertical cross section of a broad embodiment of the apparatus of the present invention describing example one. A brief description of the broad process carried out using the apparatus of the present invention will now be given using, as an example, the shrinking of prepared bonded color fiber color printed cellulosic type currency.

Example One

Before starting the described procedure below, the prepared bonded fiber color printed cellulosic type currency must be substantially moisture free (known as oven dry and/or bone dry). The prepared bonded fiber color printed cellulosic type currency, 1 to 5000 (preferably 2 to 500) cellulosic U.S. Treasury notes of any denomination are clamped individually on to an endless belt conveyor (1) which is operated by a motor (not shown) into a thermally controlled vessel (3) holding the liquid Anhydrous Ammonia (4) solution. Each cellulosic treasury note is immersed into the Ammonia solution for a period of 1 to 1000 (preferably 2 to 120) seconds, then removed by the moving belt and passed into a drying box (5) for a period of 1 to 1000 (preferably 20 to 500) seconds where a fan and heating unit (6) strips the residual Ammonia liquid and vapors from the currency and (optional) recollects the vapors in a condenser (7) which liquifies and collects the Anhydrous Ammonia in a vessel (8) for further use. The process is repeated 2 to 8 more times and a measurable shrinkage (FIG. 1 & 2) occurs for each treatment. Under the conditioned mentioned, 4 to 8 such treatments produce a final shrinkage and product. Optimum shrunken size of the prepared bonded fiber color printed cellulosic type currency is achieved at 4 to 8 immersions into the Anhydrous Ammonia solution. UNEXPECTEDLY THE TREATMENTS WITH ANHYDROUS AMMONIA USING THE ABOVE PROCESS AND APPARATUS DID NOT REMOVE THE COLOR AND PRINTING ON THE PREPARED BONDED FIBER COLOR PRINTED CELLULOSIC TYPE CURRENCY.

Figure 4:
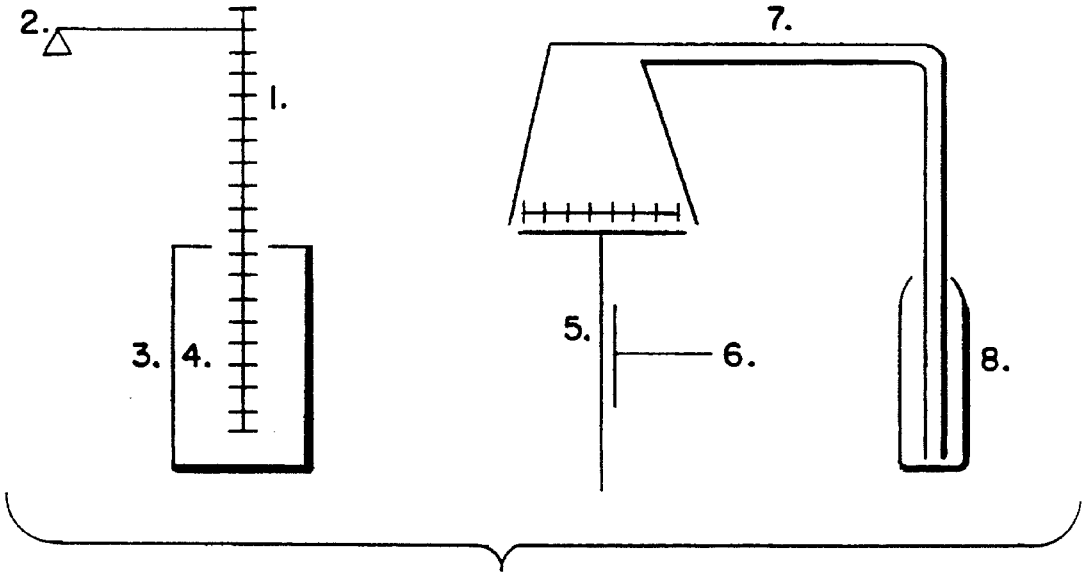
FIG. 4 shows a vertical cross section of an apparatus for shrinking and drying prepared bonded fiber color printed cellulosic type currency.

In the accompanying drawings, FIG. 4 is a diagrammatic vertical cross section of a broad embodiment of the apparatus of the present invention describing example two. A brief description of the broad process carried out using the apparatus of the present invention will now be given using, as an example, the shrinking of prepared bonded fiber color printed cellulosic type currency.

Example Two

Before starting the described procedure below, the prepared bonded fiber color printed cellulosic type currency must be substantially moisture free (known as oven dry and/or bone dry). The prepared bonded fiber color printed cellulosic type currency, 1 to 1000 (preferably 2 to 200) cellulosic U.S. Treasury notes of any denomination are clamped together by a stainless steel and/or glass tong (I) which is manually and/or automatically operated (not shown (2)). The tong is then immersed manually and/or automatically into a thermally controlled vessel (3) holding the liquid Anhydrous Ammonia solution (4). (Optional: The cellulosic U.S. Treasury notes of any denomination can be physically dropped by hand into a thermally controlled vessel holding the liquid Anhydrous Ammonia solution.) Each cellulosic Treasury note is immersed into the Anhydrous Ammonia for a period of 1 to 1000 (preferably 2 to 120) seconds, then manually and/or automatically removed and individually placed on a counter top/table to dry (5). Heating units, fans, automatic tumble dryers and/or microwave ovens can be used to speed up the drying process (not shown (6)). (Optional: Recollection of the Ammonia vapors can be passed through a condenser (7) which liquifies and collects the Anhydrous Ammonia in a vessel (8) for further use.) The process is repeated 2 to 8 more times and a measurable shrinkage (FIGS. 1 & 2) occurs for each treatment. Under the conditioned method, 4 to 8 such treatments produce a final shrinkage and product. Drying time between immersions is 1 to 1000 (preferably 20 to 500) seconds. Optimum shrunken size of the prepared bonded fiber color printed cellulosic type currency is achieved at 4 to 8 immersions into the Anhydrous Ammonia solution. UNEXPECTEDLY THE TREATMENTS WITH ANHYDROUS AMMONIA USING THE ABOVE PROCESS AND APPARATUS DID NOT REMOVE THE COLOR AND PRINTING ON THE PREPARED BONDED FIBER COLOR PRINTED CELLULOSIC TYPE CURRENCY.

A brief description of the broad process carried out using the apparatus of the present invention will now be given using, as an example, the shrinking of prepared bonded fiber color printed cellulosic type currency.

Example Three

Figure 1:
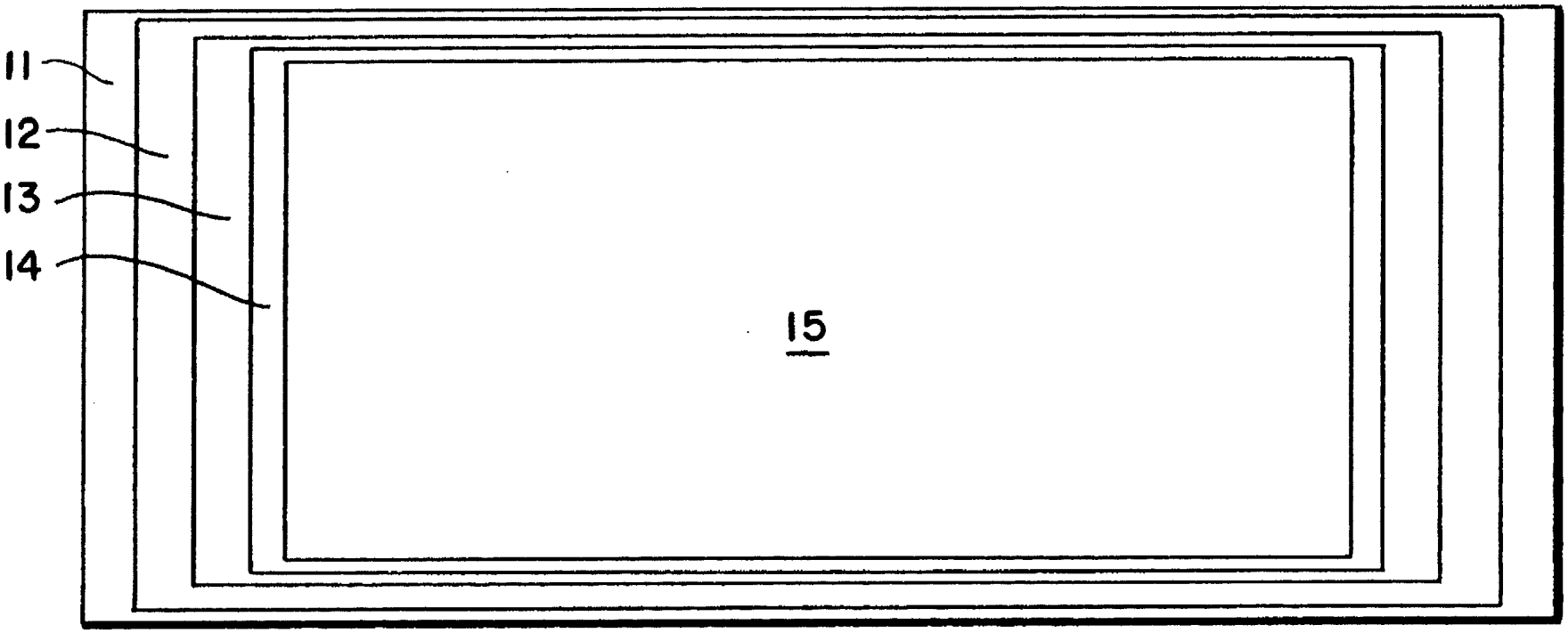
FIGS. 1 shows the shrinking characteristics of United States of America Currency.
Figure 2:
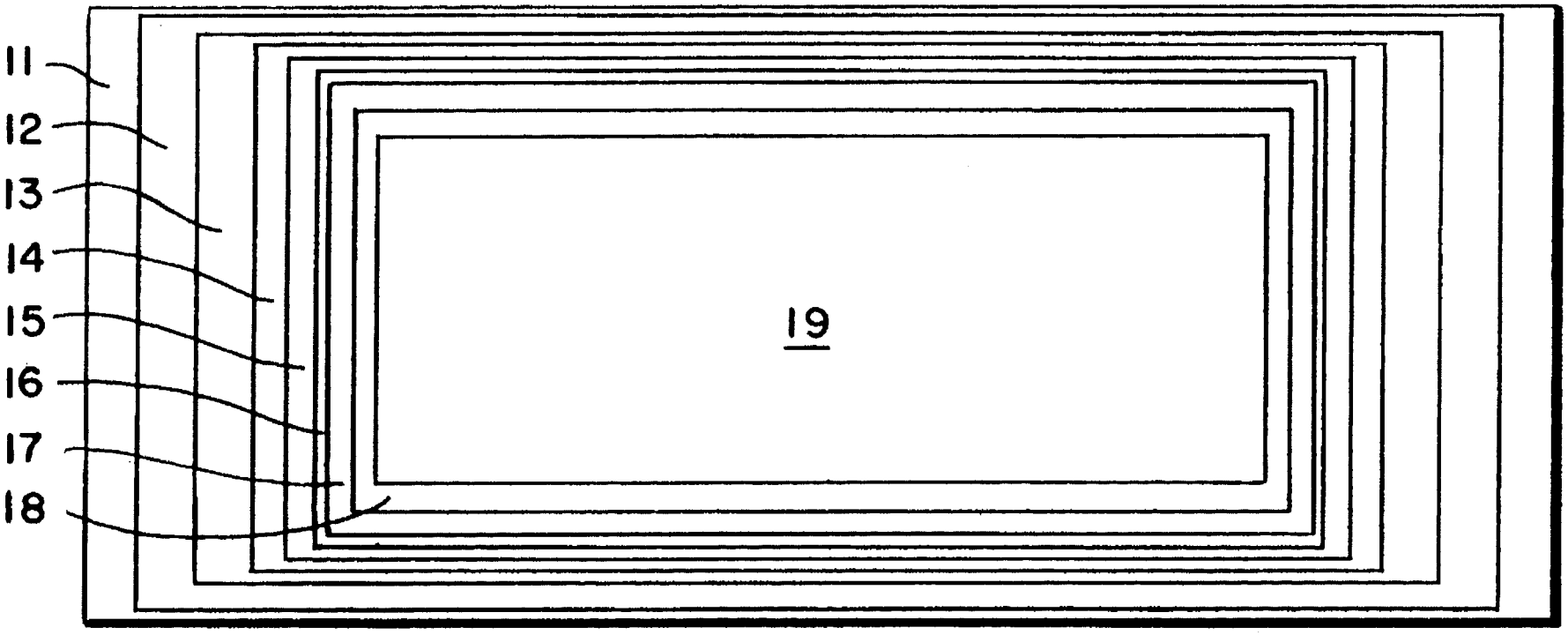
FIGS. 2 shows the shrinking characteristics of United States of America Currency.

Before starting the described procedure below, the prepared bonded fiber color printed cellulosic type currency must be substantially moisture free (known as oven dry and/or bone dry). The prepared bonded fiber color printed cellulosic type currency, 1 to 5000 (preferably 2 to 200) cellulosic U.S. Treasury notes of any denomination are placed into a stainless steel and/or glass enclosed rack (1) which is manually and/or automatically operated (not shown (2)). The rack holding the prepared bonded fiber color printed cellulosic type currency is then manually and/or automatically placed into a thermally controlled vessel (3) holding the liquid Anhydrous Ammonia solution (4). Each cellulosic Treasury note is immersed into the Ammonia solution for a period of 1 to 1000 (preferably 2 to 120) seconds, then manually and/or automatically removed and placed on a counter top/table to dry (5). Heating units, fans, automatic tumble dryers and/or microwave ovens can be used to speed up the drying process (not shown (6)). Drying time between immersions is 1 to 1000 (20 to 500) seconds. (Optional: Recollection of the Ammonia vapors can be passed through a condenser (7) which liquifies and collects the Anhydrous Ammonia in a vessel (8) for further use.) This process is repeated 2 to 8 more times and a measurable shrinkage, which is shown in FIGS. 1 and 2, occurs for each treatment. Referring to FIGS. 1 and 2, (11) represents untreated United States of America currency; (12) represents the currency after a first ammonia treatment and drying; (13) represents the currency after a second ammonia treatment and drying; (14) represents the currency after a third ammonia treatment and drying; (15) represents the currency after a fourth ammonia treatment and drying; (16) represents the currency after a fifth ammonia treatment and drying; (17) represents the currency after a sixth ammonia treatment and drying; (18) represents the currency after a seventh ammonia treatment and drying; and (19) represents the currency after an eighth ammonia treatment and drying. Under the conditioned method 4 to 8 such treatments produce a final shrinkage and product. Optimum shrinkage size of the prepared bonded fiber color printed cellulosic type currency is achieved at 4 to 8 immersions into the Anhydrous Ammonia solution. UNEXPECTEDLY THE TREATMENTS WITH ANHYDROUS AMMONIA USING THE ABOVE PROCESS AND APPARATUS DID NOT REMOVE THE COLOR AND PRINTING ON THE PREPARED BONDED FIBER COLOR PRINTED CELLULOSIC TYPE CURRENCY.

Process one, two and three operate best when the Anhydrous Ammonia liquid solution is kept at a temperature between −28° F. and −107.9° F., and the immersion time of the currency in the Anhydrous Ammonia is between 1 to 1000 (preferably 2 to 120) seconds. The product, the prepared bonded fiber color printed cellulosic type currency, may be rinsed, dipped or washed with water to remove the Ammonia odor. The product can be ironed and/or pressed between two heated (and/or unheated) pressure rollers to remove some of the wrinkles. (Other suitable equipment can be used to press and iron the shrunken prepared bonded fiber color printed cellulosic type currency.)

Therefore, it is to be understood that within the scope of the appended claims, the invention can be practiced otherwise than as specifically shown and described.

We claim:

1. A process for shrinking prepared bonded fiber color printed cellulosic currency without removing the color and printing from said currency, comprising the steps of:

(a) placing substantially moisture free prepared bonded fiber color printed cellulosic currency in a holder wherein the material which constitutes the holder is of a non-corrosive nature to anhydrous ammonia;

(b) immersing said prepared bonded fiber color printed cellulosic currency in liquid anhydrous ammonia at a temperature between −28° F. and −107.9° F. for a time of 1 to 1000 seconds;

(c) removing said prepared bonded fiber color printed cellulosic currency from the liquid anhydrous ammonia solution and then passing said prepared bonded fiber color printed cellulosic currency through a drying apparatus for a period of 1 to 1000 seconds and optionally recovering ammonia vapor and residual liquid anhydrous ammonia;

(d) repeating steps (b) and (c) for up to 2 to 8 more times;

(e) optionally washing said prepared bonded fiber color printed cellulosic currency in water;

(f) and then ironing, pressing and/or rolling between two heated or unheated rollers, said currency so as to remove any wrinkles.

2. The process of claim 1, wherein the prepared bonded fiber color printed cellulosic currency is an American Treasury note of any denomination.

3. The process of claim 1, wherein the prepared bonded fiber color printed cellulosic currency is a Canadian Bank of Canada bank note of any denomination.

4. The process of claim 1, wherein the prepared bonded fiber color printed cellulosic currency is a bank note of any denomination selected from the following countries: Japan, Germany, Switzerland, Austria, England, Korea, Taiwan, Mexico, Thailand, Singapore, China, Sweden, Denmark, France, Italy, Greece, Spain, South Africa, Brazil, Venezuela, New Zealand, Israel, Egypt, Argentina, Norway, Netherlands, Costa Rica, Finland, Belgium, Hong Kong and Portugal.

5. The process of claim 1, wherein the material which constitutes said holder is selected from glass and stainless steel.

6. The process of claim 1, wherein said time in step (b) is from 2 to 120 seconds, and said time in step (c) is from 20 to 500 seconds.

* * * * *